US006965809B2

(12) United States Patent
Dickenscheid et al.

(10) Patent No.: US 6,965,809 B2
(45) Date of Patent: Nov. 15, 2005

(54) METHOD FOR CHARACTERIZING AND SIMULATING A CHEMICAL MECHANICAL POLISHING PROCESS

(75) Inventors: Wolfgang Dickenscheid, Dresden (DE); Frank Meyer, Dresden (DE); Stephanie Delage, Paris (FR); Götz Springer, Dresden (DE)

(73) Assignee: Infineon Technologies AG, Munich (DE)

( * ) Notice: Subject to any disclaimer, the term of this patent is extended or adjusted under 35 U.S.C. 154(b) by 69 days.

(21) Appl. No.: 10/609,464

(22) Filed: Jun. 27, 2003

(65) Prior Publication Data

US 2004/0034516 A1 Feb. 19, 2004

Related U.S. Application Data

(63) Continuation of application No. PCT/DE01/04903, filed on Dec. 27, 2001.

(30) Foreign Application Priority Data

Dec. 27, 2000 (DE) ..... 100 65 380

(51) Int. Cl.[7] ..... G06F 19/00

(52) U.S. Cl. ..... 700/117; 700/121; 700/182; 438/690; 451/5

(58) Field of Search ..... 700/117, 121, 700/123, 182; 438/690, 691–692, 700; 451/5, 41

(56) References Cited

U.S. PATENT DOCUMENTS 5,599,423 A 2/1997 Parker et al.
6,057,068 A 5/2000 Raeder et al.
6,126,532 A * 10/2000 Sevilla et al. ..... 451/526
6,159,075 A 12/2000 Zhang
6,258,437 B1 * 7/2001 Jarvis ..... 428/137
6,809,031 B1 * 10/2004 Lacy ..... 438/690

FOREIGN PATENT DOCUMENTS

WO 99/25520 5/1999

OTHER PUBLICATIONS

J. Tony Pan et al.: "Planarization and Integration of Shallow Trench Isolation", *1998 Proceedings of the Fifteenth International VLSI Multilevel Interconnection Conference*(VMIC), *Santa Clara*, CA, Jun. 16–18, 1998, pp. 467–472.

(Continued)

*Primary Examiner*—Kidest Bahta
(74) *Attorney, Agent, or Firm*—Laurence A. Greenberg; Werner H. Stemer; Ralph E. Locher

(57) ABSTRACT

A method for characterizing and simulating a CMP process, in which a substrate to be polished, in particular a semiconductor wafer, is pressed onto a polishing cloth and is rotated relative to the latter for a defined polishing time. The method includes defining a set of process parameters, in particular a compressive force and a relative rotational speed between a substrate and polishing cloth; preparing and characterizing a test substrate having test patterns with different structure densities using the defined process parameters; determining a set of model parameters for simulating the CMP process from results of the characterization of the test substrate; determining layout parameters of the substrate which is to be polished; defining a profile of demands for a CMP process result for the substrate to be polished; and simulating the CMP process in order to determine the polishing time required to satisfy the profile of demands.

21 Claims, 6 Drawing Sheets

OTHER PUBLICATIONS

George Y. Liu et al.: "Chip–Level CMP Modeling and Smart Dummy for HDP and Conformal CVD Films", *1999 Proceedings of the Fourth International Chemical–Mechanical Planarization for ULSI Multilevel Interconnection Conference* (*CMP–MIC*), *Santa Clara, CA Feb. 11–12, 1999*, pp. 120–127.

Valeriy Sukharev: "Addressing the pattern density effects in deposition, etch and CMP by means of simulations", *2001 Proceedings of the Sixth International Chemical–Mechanical Planarization for ULSI Multilevel Interconnection Conference* (*CMP–MIC*), *Santa Clara, CA, Mar. 7–9, 2001*, pp. 403–413.

Carsten Schmitz et al.: "CMPSIM—Ein Simulator für den Planarisierungsprozess auf Layout Ebene" [ CMPSIM—a simulator for the planarization process on the layout level], *internal memo, Infineon Technologies AG, München, Nov. 26, 1999*, pp. 1–17.

Smith, T.H.: "A CMP Model Combining Density and Time Dependencies", Proc.CMP–MIC, 1999, 8 pages.

Ouma, D. et al.: "An Integrated Characterization and Modeling Methodology for CMP Dielectric Planarization", Massachusetts Institute of Technology, 3 pages.

Stine, B. et al.: "A Closed–Form Analytic Model for ILD Thickness Variation in CMP Processes", Proc.CMP–MIC, 1997, pp. 1–7.

* cited by examiner

METHOD FOR CHARACTERIZING AND SIMULATING A CHEMICAL MECHANICAL POLISHING PROCESS

CROSS-REFERENCE TO RELATED APPLICATION

This application is a continuation of copending International Application No. PCT/DE01/04903, filed Dec. 27, 2001, which designated the United States and was not published in English.

BACKGROUND OF THE INVENTION

Field of the Invention

The present invention relates to a method for characterizing and simulating a chemical mechanical polishing process, in which a substrate that is to be polished, in particular a semiconductor wafer, is pressed onto a polishing cloth and is rotated relative to the latter for a defined polishing time.

Chemical mechanical polishing (CMP) is a method for planarizing or polishing substrates that is in widespread use in particular in semiconductor manufacturing. By way of example, planarized surfaces have the advantage that a subsequent exposure step can be carried out with a higher resolution, since the required depth of focus can be lower on account of the reduced surface topography.

In this context, the problem arises that different structure densities and spacings in the layout of a semiconductor chip influence the planarizing properties of the CMP process. Inappropriately selected process parameters then lead to a considerable fluctuation in the layer thickness (global topography) over the chip surface after the CMP process. On the other hand, an unfavorably selected circuit layout also leads to insufficient planarization. In this context, the inadequate planarization, on account of the associated layer thickness variations over the chip surface or the image field surface of a subsequent exposure step, has an adverse affect on the subsequent processes and therefore also on the product properties. In particular the process window of a subsequent lithography step is reduced in size on account of the reduced depth of focus.

Hitherto, the process parameters to be set for the CMP process have generally been adapted specifically for each new layer to be polished on the semiconductor wafer and for almost every new product. For each CMP process there are numerous process parameters, such as the rotational speeds of polishing plate and substrate holder, the compressive force, the polishing time, the condition of the polishing cloth or the choice of polishing abrasive. Furthermore, the deposition thickness of the layer which is to be planarized has to be matched to the planarization properties of the CMP process used and the structure densities and sizes of the chip layout.

The optimum parameters are typically determined in a series of test gradings by trial and error. These tests entail a not inconsiderable time and cost outlay and also require a sufficient number of wafers of a new product layout to be available.

Furthermore, it is difficult to measure the resultant global topography on the test wafers, and consequently in practice it is often only the less relevant local planarization properties that are analyzed.

SUMMARY OF THE INVENTION

It is accordingly an object of the invention to provide a method for characterizing and simulating a chemical mechanical polishing process that overcomes the above-mentioned disadvantages of the prior art methods of this general type, in which the CMP process can be characterized in such a manner that for a given product layout the process result can be predicted without carrying out tests on real layout substrates.

The method according to the invention for characterizing and simulating a CMP process, in which a substrate which is to be polished, in particular a semiconductor wafer, is pressed onto a polishing cloth and is rotated relative to the latter for a defined polishing time, includes the steps of: defining a set of process parameters, in particular compressive force and relative rotational speed between the substrate and the polishing cloth; preparing and characterizing a test substrate having test patterns with different structure densities at the defined process parameters; determining a set of model parameters for simulating the CMP process from the results of the characterization of the test substrate; determining layout parameters of the substrate which is to be polished; defining a profile of demands on the CMP process result for the substrate which is to be polished; and simulating the CMP process in order to determine the polishing time required to satisfy the profile of demands.

The method according to the invention has the advantage that an experimental characterization only has to take place once for a specific set of process parameters, specifically on a test substrate that has test patterns with different structure densities. The results of the characterization of the test substrate are used to determine a set of model parameters with which the CMP process can then be simulated for any desired layout.

Then, for a given layout layout, parameters which form input variables for the simulation are determined. The demands imposed on the process result, for example a certain approximation to the optimum achievable global step height, are also defined. By simulating the CMP process, it is then possible to determine the polishing time required for this layout from the generally applicable model parameters and the specific layout parameters without experimental test grading using the layout itself being required.

Therefore, it is possible to determine on a theoretical basis, without using product wafers, whether a selected layout can be polished in the desired way using a specific process. It is also possible to reach conclusions as to the CMP process window. Therefore, the result is a considerable saving on time and costs in the technological development of new products.

The test patterns of the test substrate contain regions with high (up) areas and low (down) areas of a defined step height, for example isolated blocks or line patterns. The ratio of up areas to down areas determines the structure density, the limits of which are formed by a density of 0% (only down areas) and 100% (only up areas). A preferred test substrate includes line patterns with a period (the width of the up and down areas together) of 250 $\mu$m for structure densities of 4% to 72%.

In one configuration of the method, the test substrate is characterized in an experimental polishing time grading in which the layer thickness development of the test patterns is measured in dependence on the polishing time.

Preferably, the set of model parameters determined contains the abrasion rate, the hardness of the polishing cloth, and a characteristic filter length for determining effective structure densities. In this case, an effective structure density is obtained from the specific structure density of a layout by determining or forming a suitable mean over an area of a certain size.

It is preferable for the mean to be formed by convolution of the specific structure density with a weighting function. The weighting function selected is expediently a two-dimensional Gaussian distribution, and the characteristic filter length is in this case the half-width value of the Gaussian curve. However, there are also other suitable weighting functions, for example square, cylindrical and elliptical weighting functions. According to current knowledge, the elliptical and Gaussian weighting functions have the minimum errors and are therefore preferably used.

The abrasion rate and the hardness are advantageously determined from the layer thickness development of a test pattern with a mean structure density. In this context, it is expedient for the abrasion rate to be determined from the pitch of the layer thickness development for long polishing times, and for the hardness of the polishing cloth to be determined from the speed at which the up and down areas of the test patterns reach the abrasion rate. The values for the abrasion rate and the hardness can, for example, be obtained by matching a local polishing model to the experimental results of a polishing time grading.

The filter length is advantageously determined from the global step height of all the test patterns on the test substrate. In this case, the global step height is the difference in layer thickness between the maximum layer thickness measured value for all the up areas and the minimum layer thickness measured value for all the down areas. Since the global step height therefore represents a correlation over the surface of the entire layout, it is quite plausible that a significant global step height may remain even though the local steps have already been leveled by the polishing operation. However, it is the global step height over the image field area of a subsequent exposure step (for example $21\times21$ $mm^2$) that is crucial to the depth of focus of the exposure step.

In one configuration of the method, the layout parameters of the substrate used are the minimum and maximum effective structure density, $\rho_{min}$ and $\rho_{max}$, and the starting step height. The effective structure densities in turn result from the specific structure density of the layout by forming a suitable mean over an area of a certain size, characterized by the filter length.

In a further configuration, a surface coverage with structures is determined for at least one region on the substrate, in order subsequently to use a cross-sectional profile of the corresponding structures to calculate a local structure density from the surface coverage and the cross-sectional profile of the structures. This is because the starting topography that is to be planarized by a CMP process is not determined by the layout directly, but rather is also determined by the preceding processes, such as for example an etching or deposition process.

In this context, account is taken of the fact that, by way of example, structures which have been etched in a preceding process or covered with a layer no longer have a box-shaped or rectangular profile, but rather on the one hand have an edge which is set back or projects with respect to its base and on the other hand also have angled or curved edges. Recesses or angled edges for a given surface coverage lead to a reduction in the structure density compared to box-shaped structures of precise surface area and therefore also to a reduction in the amount of material to be removed, while projecting edges lead to an increase. The effective structure density is then calculated by forming the mean over the filter length.

The simulation method therefore also takes account of the preceding process. For a given structure having a width and a height, it is possible to cite a cross-sectional profile for a specific known preceding process. To do this, it is possible to store corresponding measured data in tables in order for them then to be assigned to the structures of the existing surface coverage during the simulation, or alternatively it is possible to cite simplified geometric formulae which are applied to the corresponding profile of the structure below.

To calculate the local structure density, a first volume is calculated by integration of the cross-sectional profile over the basic area of a structure and then the first volume is divided by a second volume, which is calculated from the product of the basic area of the structure and the starting height. Given a mathematically predetermined function of the cross-sectional profile, the integration can be carried out directly, or alternatively numerical integration is carried out by use of nested intervals. The two integrals converge as the number of interval steps moves towards infinity.

The profile of demands that has been defined is preferably given by a global step height to be achieved on the substrate after the CMP process has been carried out, since the global step height has a crucial influence on the depth of focus of a subsequent exposure step.

In one configuration of the simulation method, the deposition thickness required to carry out the CMP process is determined in addition to the required polishing time in the simulation.

The simulation preferably also determines the minimum global step height that can be achieved. This determination is based on the discovery that for sufficiently long polishing times the local steps have disappeared and the global step height only changes to a negligible extent. For the limit scenario of an infinitely long polishing time, the result is a residual global step height which is dependent only on the starting step height and on the minimum and maximum effective structure density which can be achieved in the layout which is to be polished.

If the minimum achievable step height is determined, it is recommended for the global step height that is to be achieved to be selected as a function of the minimum achievable global step height. By way of example, working on the basis of the starting step height, it is required to achieve 80%, 90% or 95% of the difference between the starting step height and the minimum achievable global step height. A procedure of this type represents a compromise between being sufficiently close to optimum planarization and the demand for short polishing times.

The invention also includes a method for the chemical mechanical polishing of a substrate, in particular of a semiconductor wafer, in which a CMP process is simulated as described, a layer which is to be planarized is deposited on a substrate and the substrate is polished for a polishing time determined from the simulation. As has been stated, it is not necessary to carry out a new experimental test grading for each new substrate layout. Rather, the results of an experimental characterization of a test substrate can be used for a wide range of product layouts.

In the polishing method, the CMP process is preferably simulated using a method that also provides the required deposition thickness as a simulation result. The layer that is to be planarized is then deposited in the required thickness before the polishing step.

Other features which are considered as characteristic for the invention are set forth in the appended claims.

Although the invention is illustrated and described herein as embodied in a method for characterizing and simulating a chemical mechanical polishing process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 5:
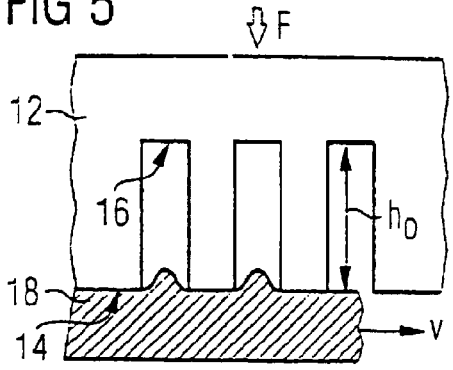
FIG. 5 is a diagrammatic illustration relating to the definition of sizes used in a CMP polishing process.

Referring now to the figures of the drawing in detail and first, particularly, to FIG. 5 thereof, there is shown diagrammatically, to define the sizes used, a wafer 12 which is to be polished and a polishing cloth 18. The wafer 12 has a structure containing high up areas 14 and low down areas 16 with a step height $h_0$. On account of the rotational movements, a local relative speed v results between the wafer 12 and the polishing cloth 18 at any location. A compressive force F and a surface area of the wafer 12 can be used to determine a local abrasion rate in a known way using the Preston's equation.

Figure 1:
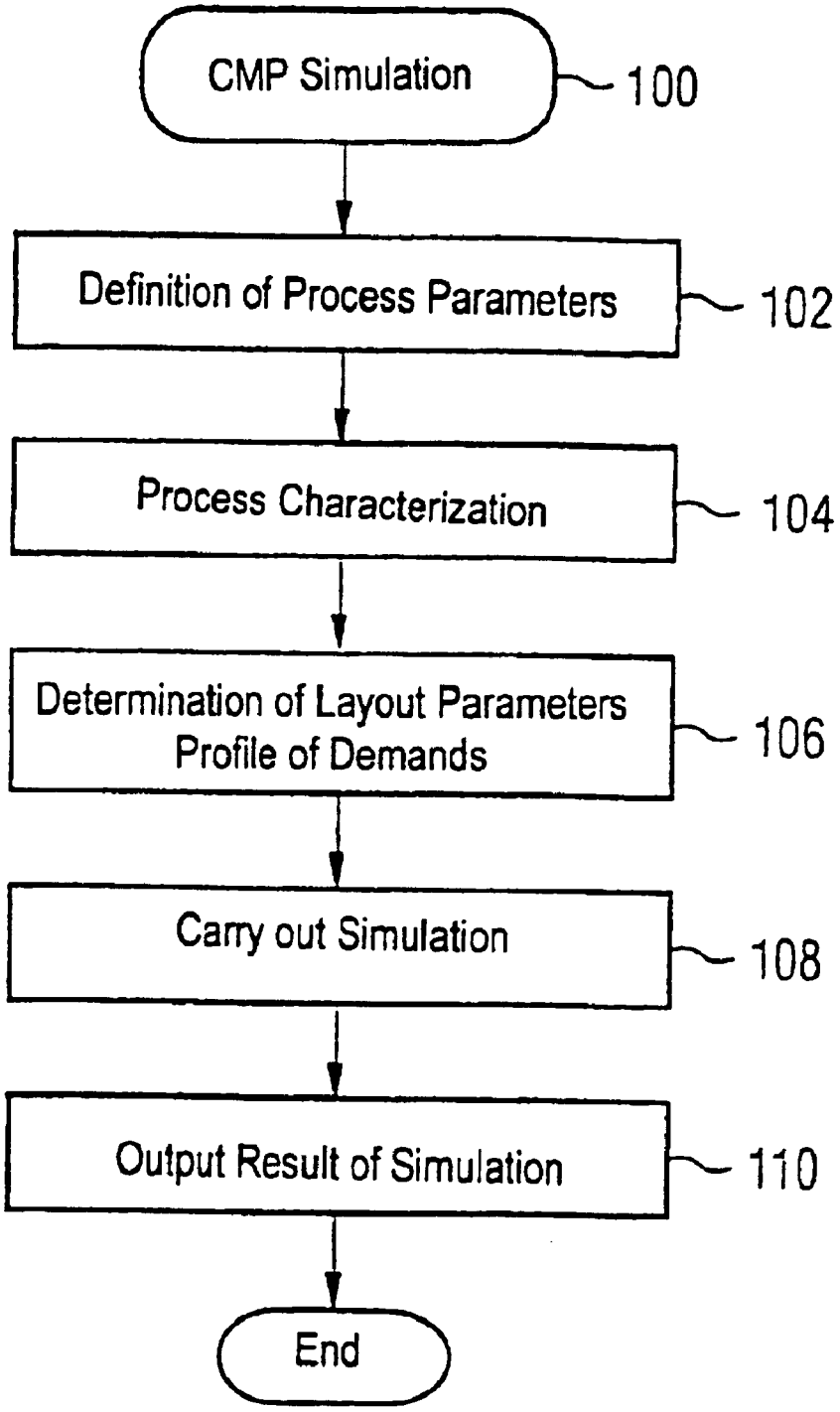
FIG. 1 is a flow diagram of a CMP simulation method according to the invention.

FIG. 1 shows a flow diagram of an exemplary embodiment of a chemical mechanical polishing (CMP) simulation method 100. In a first step 102, a relative speed of the wafer 12 and the polishing cloth 18 and the compressive force, for example a relative rotational speed or table speed (TS)=35 rpm (revolutions per minute) and a compressive force of 6 psi, are defined as process parameters of the process which is to be characterized.

Figure 2:
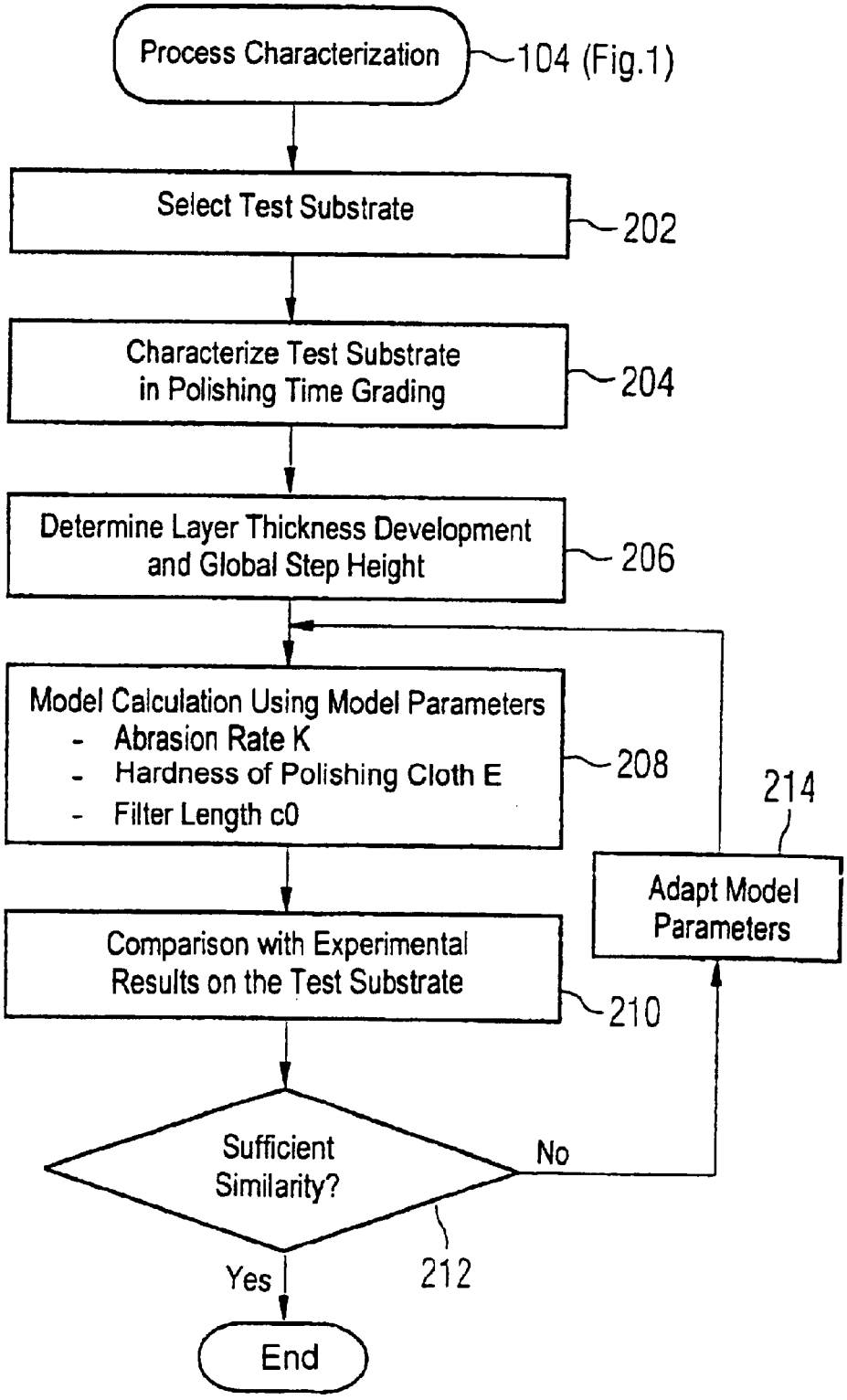
FIG. 2 is a flow diagram illustrating a subroutine of the flow diagram shown in FIG. 1 in more detail.

In step 104, the selected process is completely characterized as a one-off. To do this, as illustrated in the flow diagram presented in FIG. 2, first a suitable test substrate is selected (reference numeral 202). In the exemplary embodiment, the test substrate has test patterns containing isolated blocks and line patterns with different structure densities of 4% to 72%. All the structures of the test patterns have relatively large dimensions ($\geqq 10\ \mu$m) in order to allow simple optical examination of the structures and to enable their development to be evaluated as a function of the polishing time.

The test substrate is characterized in step 204, the result obtained being the layer thickness development for various structure densities as well as the global step height as a function of the polishing time (reference numeral 206).

Then, in steps 206 to 214, the experimental values are reproduced by use of a local CMP model with a global density by matching model parameters abrasion rate K, polishing-cloth hardness E and filter length c0.

Figure 3:
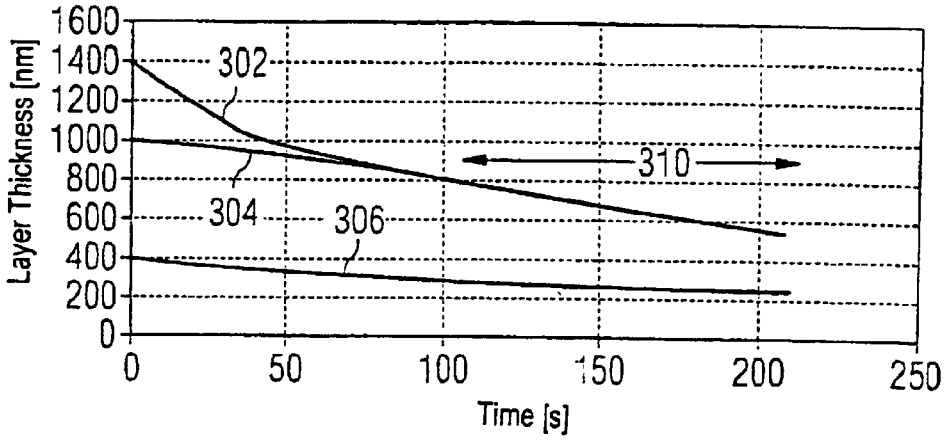
FIG. 3 is a graph plotting a measured layer thickness in the up area and down area of a structure of average density and also a global step height as a function of polishing time.

The abrasion rate K and the hardness of the polishing cloth E are determined from the layer thickness development of a test pattern of average structure density, as illustrated in FIG. 3.

FIG. 3 plots the measured layer thickness in the up area (reference numeral 302) and down area (reference numeral 304) of a structure of average density. It can be seen that substantially only the high, up area is abraded, while the abrasion rate in the down area is low.

At slightly longer times, the down area is also abraded, and for relatively long polishing times the abrasion rates for the up and down areas converge (reference numeral 310). The pitch of the layer thickness curves in the area 310 is then a measure of the abrasion rate K.

The hardness E of the polishing cloth determines how quickly the up and down areas reach the abrasion rate. The precise values for K and E are determined by matching a local model to the results of the polishing time grading. The details of a local model of this type are described, for example, in the article titled "A CMP Model Combining Density And Time Dependencies" by Taber H. Smith et al., Proc. CMP-MIC, Santa-Clara, Calif., February 1999.

The filter length c0 is obtained from the development of the global step height over the course of time. The global step height is in this case the layer thickness difference between the maximum layer thickness measured value of all the up areas and the minimum layer thickness measured value of all the down areas at each time, $$St_{global}(t)=\mathrm{Max}_{Up}-\mathrm{Min}_{Down}. \quad (1)$$

As can be seen from the plot of the measured global step height 306 illustrated in FIG. 3, the global step height is still significant when the local step height, i.e. the difference between the layer thickness in the up area (reference numeral 302) and the layer thickness in the down area (reference numeral 304) has already virtually disappeared for a test structure of defined structure density.

The CMP model is now matched to the profile of the global step height by obtaining an effective structure density $\rho(x,y)$, which is likewise included in the model calculation, from the specific structure density $\rho_0(x,y)$ of the test substrate by convolution with a weighting function.

Each weighting function in this case has a characteristic filter length c0, which indicates the size of the area used to form the mean. In the exemplary embodiment, the weighting function selected is a two-dimensional Gaussian distribution with a half-width value c0.

It has now been found that for given process parameters the global step height $St_{global}(t)$ which remains, given sufficiently long polishing times, is dependent only on the starting step height $h_0$ and on the minimum and maximum effective densities of the layout, in this case of the test substrate:

$$St_{global}(t\rightarrow\infty)=h_o(\rho_{max}-\rho_{min}) \quad (2)$$

Since $\rho_{max}$ and $\rho_{min}$ are dependent on c0, the filter length can be determined by comparing equation (2) with equation (1) for sufficiently long times.

In the model calculation, therefore, the value of the filter length c0 is a fit parameter which is iteratively adapted until the simulated data sufficiently match the data determined experimentally in the polishing time grading (steps 208, 210, 212, 214).

Figure 4:
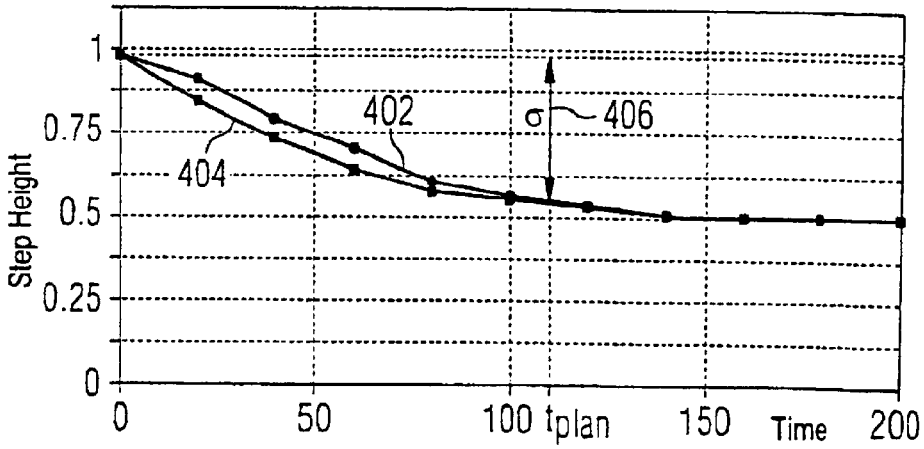
FIG. 4 is a graph plotting the measured global step height and the global step height obtained from the CMP simulation model as a function of the polishing time.

FIG. 4 shows the result of a CMP simulation after adjustment of the filter length c0. FIG. 4 illustrates the measured global step height 402 and the global step height 404 obtained from the model as a function of the polishing time.

At the end of the process characterization 104, the model parameters K, E and c0 have been matched to the selected process conditions. The result is then a simulation model that can be applied to any desired product layout without further free parameters.

Returning now to FIG. 1, in step 106 layout parameters are determined for specific application to a product layout. For this purpose, the minimum and maximum effective densities of the product layout and the starting step height are determined from the specific structure density of the product layout, which is known from measurements or from the design data, by use of the weighting function with the filter length c0.

A simulation of the CMP process for the product layout using the previously determined values for K, E and c0 then directly results in the local and global step heights as a function of the polishing time.

As can be seen from the global step height plotted in FIG. 4, the global step height does not drop to zero over the course of time, but rather, after a sufficiently long polishing time, tends toward its limit value given by equation (2). There is therefore no point in continuing polishing for a very long time, since this lengthens the process time without significantly improving the process result.

Therefore, in step 106 of the simulation method, a profile of demands imposed on the CMP process result is defined; satisfying the profile of demands results in that the polishing process can be ended. For this purpose, in the exemplary embodiment a variable $\sigma$ is determined, for example at a value of 0.95, indicating what proportion of the maximum achievable polishing result is sufficient for the specific polishing process.

This cessation condition then enables the CMP simulation to determine the polishing time $t_{plan}$ required. This results from the equation $$St_{global}(t_{plan})-St_{global}(t\rightarrow\infty)=(1-\sigma)(h_0-St_{global}(t\rightarrow\infty)),$$

i.e. for $\sigma$=0.95, the global step height is reduced by 95% of the maximum possible reduction from $h_0$ within the polishing time $t_{plan}$.

Furthermore, a layer thickness $S_{down}$ which has been abraded in the down area with the lowest effective structure density at the time $t_{plan}$ can be used to determine the deposition thickness A required to achieve this degree of planarization:

$$A=S_{down}(t_{plan}, \rho_{min})+h_0$$

Therefore, the material thickness which is to be applied, the required planarization time and the resulting global step height can be determined by the simulation without it being necessary to use real product wafers.

In an alternative exemplary embodiment, to determine the effective structure density by subtraction or addition of critical structure sizes from the surface coverage $\rho'(x,y)$ according to the chip layout which are characteristic of the preceding processes and for subsequent surface coverage determination, the density of the surface topography of the structures following the preceding process is determined.

In this case, the specific structure density during the deposition is defined as the ratio of volume to the product of a window area 400 of individual structures or of a field of structures under consideration and the maximum step height $h_0$. In the case of precisely one structure, this corresponds to the basic area of the structure. Since the filter length c0 of a CMP process is approximately 1 mm, it is possible for the window areas 400 within which this surface coverage is determined to be selected to be small compared to the filter length c0 but large compared to an individual structure.

Figure 6:
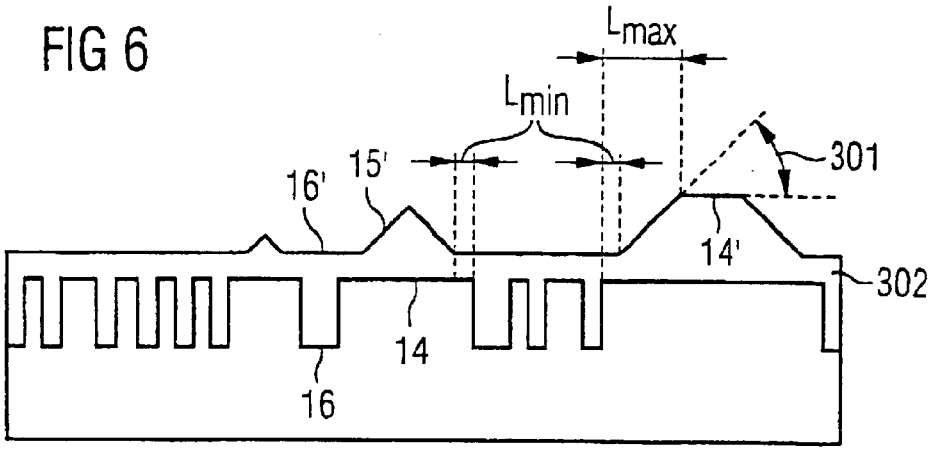
FIG. 6 is a cross-sectional profile of a substrate with structures on which an HDP deposition process has been carried out.

An exemplary embodiment considered here is an algorithm for determining the HDP deposition topography on a metal level. FIG. 6 shows a typical determined cross-sectional profile of a layer 302 deposited in this manner. The HDP deposition is used to fill trenches with a high aspect ratio. Structures with a lateral size below a defined dimension (on the left-hand size in FIG. 6) are grown over completely, with the result that flattened down areas 14' of a new surface topography are formed. More oxide is deposited on structures that are larger (on the right-hand side in FIG. 6), so that up areas 14' that have been changed from the structure layout are formed, and a flank 15' is formed at their edges. The flank 15' is characteristic of the HDP process. It changes with the process parameters of the HDP process.

Figure 7A:
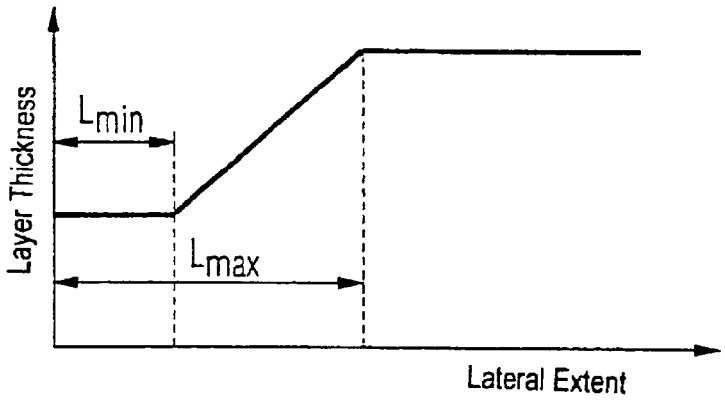
FIG. 7A is a graph illustrating the layer thickness applied in an HDP process as a function of the lateral extent of a structure.

If the deposition height is plotted against the lateral structure size (FIG. 7A), the result, in addition to the angle 301 of the flank 15', is two further characteristic lateral variables $L_{min}$ and $L_{max}$. $L_{min}$ is half the lateral dimension below that a uniform deposition thickness grows over all the structures of the structured metal layer. The thickness is the deposition height on an unstructured surface, reduced by the trench depth. Structures with a lateral extent of twice $L_{max}$ in turn have a constant deposition thickness grown over them and form a trapezoid (on the right-hand side of FIG. 6). In this case, the height of the trapezoid is the deposition thickness on an unstructured surface. The structures between twice $L_{min}$ and $L_{max}$ are characterized in the profile by their pointed triangular shape (middle of FIG. 6). The relationship between structure size and deposition thickness can in turn be defined by simulation or by SEN images and can be stored.

Figure 7B:
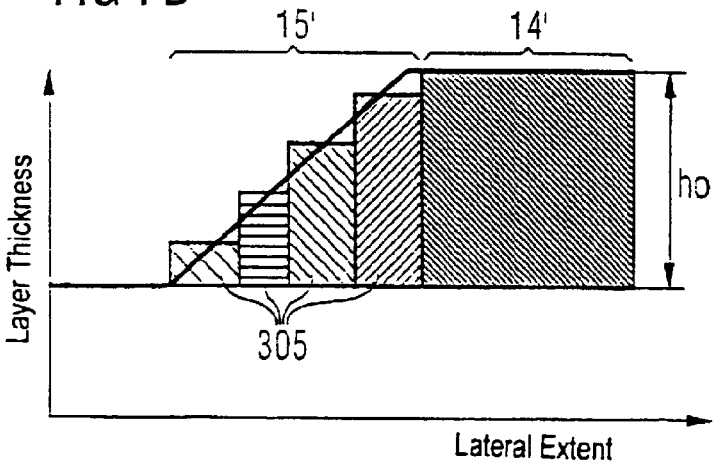
FIG. 7B is a graph illustrating the layer thickness applied in an HDP process as an integration of the profile by nested intervals.

When using numerical methods, the window area 400 is shifted over the layout and the surface coverage $\rho'(x,y)$ therein is determined. As down areas 16', the surfaces associated with the regions $L_{min}$ do not make any contributions to the effective structure density, even though they contribute to the surface coverage. The areas of the edges 15' which are assigned to the regions $L_{max}$ are divided, by nested intervals, into a number n of intervals 305 each of known basic areas and are each provided with a mean value for the local structure height (FIG. 7B). An inner region once again has a plateau, i.e. the up area 14' of height $h_0$ with respect to the down area. The product of the individual partial areas and the associated local structure heights results in the volume taken up by the material of the layer 302. This is set in a relationship with respect to a volume that results from the product of the height $h_0$ times the window area 400.

Figure 8A:
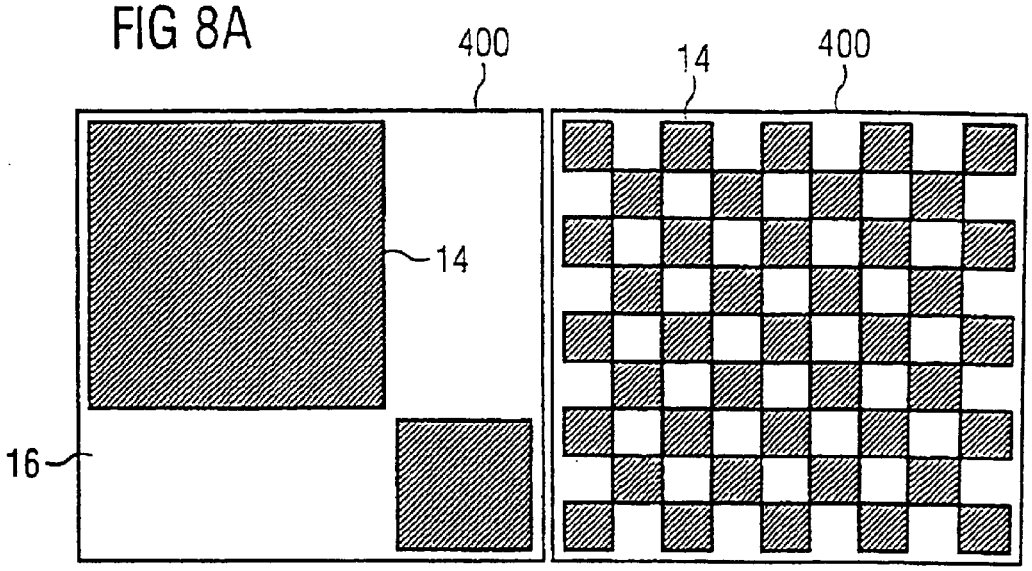
FIG. 8A is a plan view of the surface coverage of two windows with structures before an HDP process.
Figure 8B:
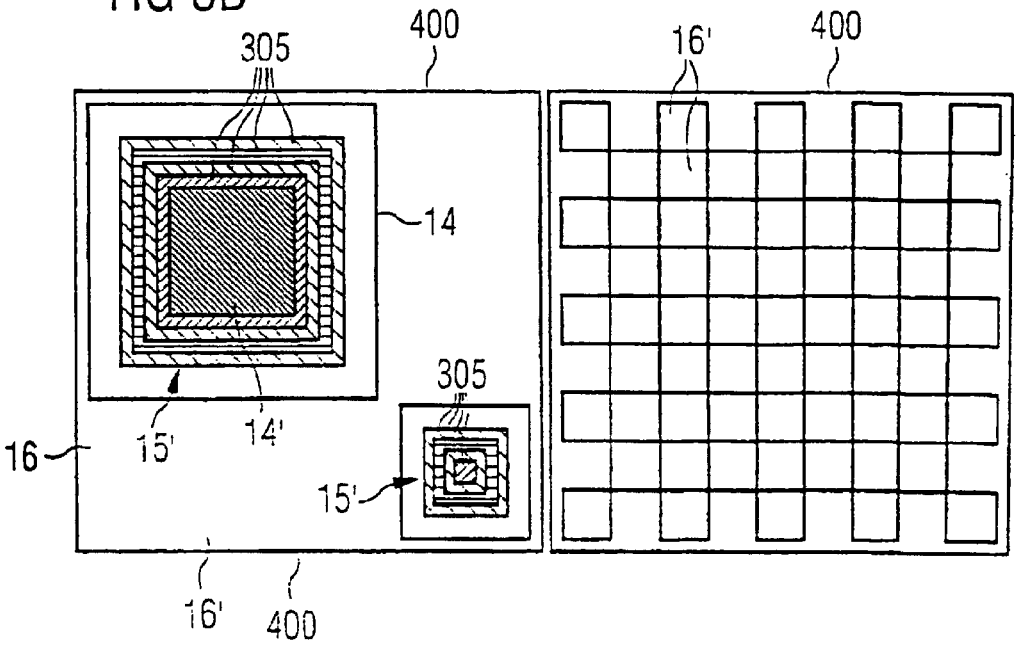
FIG. 8B is a plan view of the surface coverage of two windows with structures after the HDP process.

The result of the example HDP process is illustrated in FIGS. 8A and 8B. FIG. 8A shows two different surface coverages with the same structure densities in in each case one window area. The structures of the layout, i.e. the up areas 14, are illustrated in solid black. FIG. 8B accordingly in each case shows the remaining structure contributions after the topography of the HDP deposition process has been taken into account. The edges provided with an angle of inclination 301 are placed beneath in graded grey shades in FIG. 8B in order to provide a plan view of the nested intervals. The result for the HDP process is not only a reduction in the structure densities compared to the layout, but also that this reduction is determined as a function of the structure extent or size, as can be seen from a comparison between the two windows 400 in FIG. 8B. The finer structures in the layout (smaller up areas 14 and down areas 16) even provide exclusively down areas 16' following the HDP process.

Figure 9A:
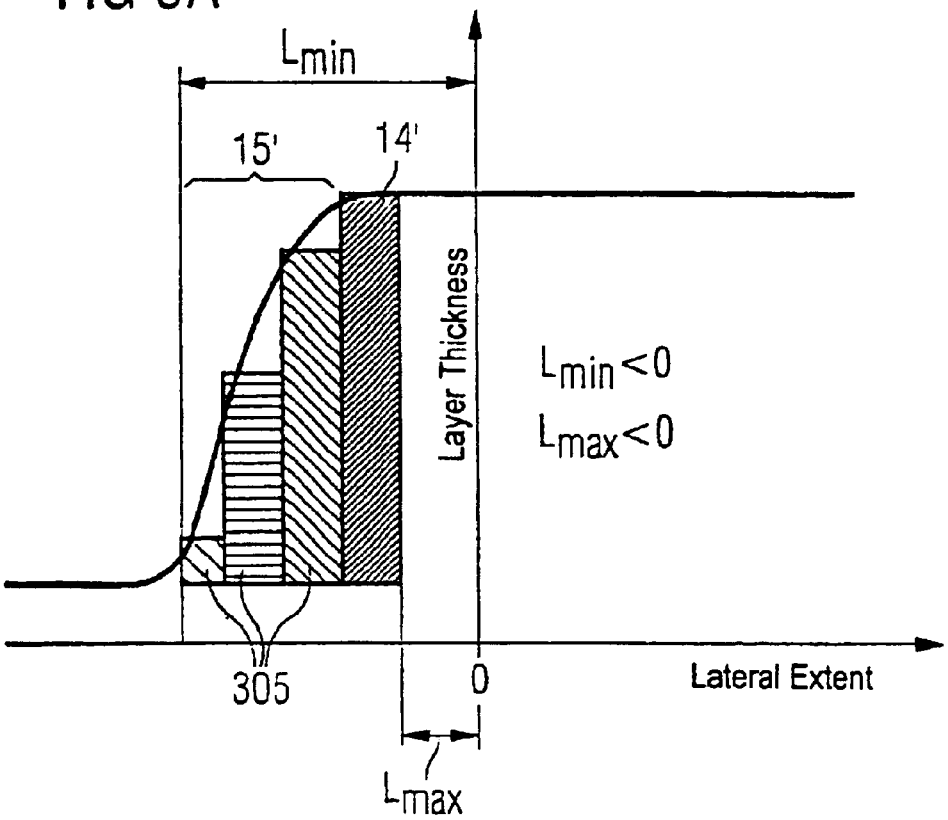
FIG. 9A is a graph showing a diagram as in FIG. 7 but for a conformal deposition process.
Figure 9B:
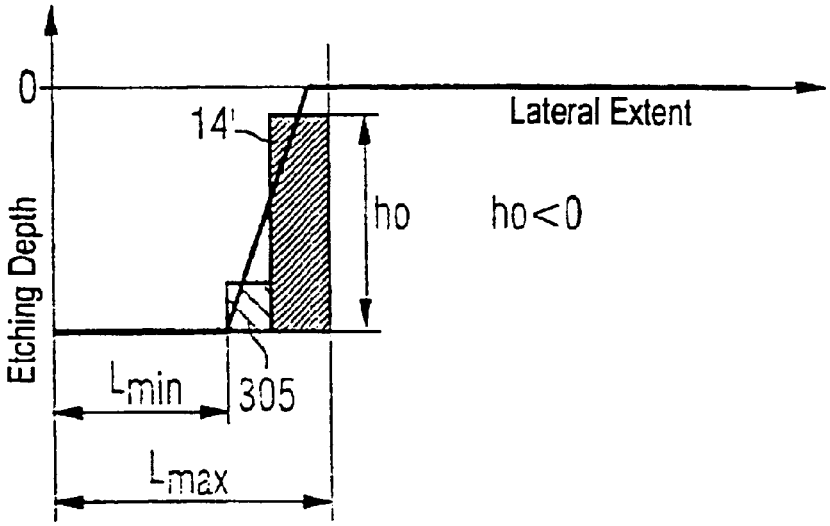
FIG. 9B is a graph showing a diagram as in FIG. 7 but for an etching process.

FIGS. 9A and 9B show further examples of processes with a deposition height or the structure height plotted against the lateral structure extent, specifically for a conformal deposition process on structures with a low aspect ratio (FIG. 9A) and an etching process (FIG. 9B). The, for example, experimentally determined variables $L_{min}$ and $L_{max}$ and also $H_0$ may in this case also adopt negative values i.e. by way of example may have the effect of increasing the topography compared to the structure from the layout.

The determination of the layout parameters $\rho_{min}$ and $\rho_{max}$ as the minimum and maximum values for the effective structure density is carried out after the mean has been formed for the specific structure density having the filter length $c_0$ as calculated from the cross-sectional profile and the surface coverage.

Of course, it is also within the scope of the invention to select a different set of process parameters, to carry out the CMP simulation using this set of parameters and to compare the results with those obtained above in order to optimally adapt the process parameters to a given product layout.

We claim:

1. A method for characterizing and simulating a chemical mechanical polishing (CMP) process for a substrate to be polished by a polishing cloth and rotated relative to the polishing cloth for a defined polishing time, which comprises the method steps of:

defining a set of process parameters;

preparing and characterizing a test substrate having test patterns with different structure densities using the process parameters defined;

determining a set of model parameters for simulating the CMP process from results of the characterizing of the test substrate;

determining layout parameters of the substrate to be polished;

defining a profile of demands for a CMP process result for the substrate to be polished;

simulating the CMP process for determining the defined polishing time required for satisfying the profile of demands; and outputting the defined polishing time for use in polishing process.

2. The simulation method according to claim 1, which further comprises during the preparing and characterizing step, characterizing the test substrate in an experimental polishing time grading sequence.

3. The simulation method according to claim 1, which further comprises forming the set of model parameters to include an abrasion rate, a hardness of the polishing cloth, and a characteristic filter length for determining effective structure densities.

4. The simulation method according to claim 3, which further comprises determining the abrasion rate and the hardness from a layer thickness development of a test pattern with a mean structure density of the test substrate.

5. The simulation method according to claim 3, which further comprises determining the filter length from a global step height of all the test patterns of the test substrate.

6. The simulation method according to claim 3, which further comprises forming the layout parameters of the substrate to include a minimum and maximum effective structure density determined over the filter length and a starting step height.

7. The simulation method according to claim 1, which further comprises defining the profile of demands from a global step height to be achieved on the substrate after the CMP process has been carried out.

8. The simulation method according to claim 7, which further comprises determining a deposition thickness required to carry out the CMP process during the simulating step.

9. The simulation method according to claim 8, which further comprises determining a minimum achievable global step height during the simulating step.

10. The simulation method according to claim 9, which further comprises selecting the global step height to be achieved in dependence on the minimum achievable global step height.

11. The simulation method according to claim 6, which comprises performing the following steps during the step of determining the layout parameters:

determining a surface coverage of structures for at least one region on the substrate;

determining a cross-sectional profile of the structures;

calculating a local structure density from the surface coverage and the cross-sectional profile of the structures; and calculating an effective structure density from the local structure density by forming a mean over the filter length.

12. The simulation method according to claim 11, wherein the cross-sectional profile is dependent on a type of process which can act on the substrate and the structures.

13. The simulation method according to claim 12, wherein the cross-sectional profile is dependent on a structure size.

14. The simulation method according to claim 13, which further comprises selecting the type of process from the group consisting of a deposition process and an etching process, and the cross-sectional profile has at least one edge with an angle of inclination with respect to a surface of the substrate which is not 90 degrees.

15. The simulation method according to claim 14, which further comprises calculating a first volume by integration of the cross-sectional profile over a basic area of a structure for performing the step of calculating the local structure density.

16. The simulation method according to claim 15, which further comprises dividing the first volume by a second volume calculated from a product of the basic area of the structure and the starting step height.

17. The simulation method according to claim 1, which further comprises defining the set of process parameters to include a compressive force and a relative rotational speed between the substrate and the polishing cloth.

18. The simulation method according to claim 1, which further comprises using a semiconductor wafer as the substrate.

19. A method for chemically mechanically polishing a substrate, which comprises the steps of:

performing a method for characterizing and simulating the chemical mechanical polishing (CMP) process, by the steps of:

defining a set of process parameters;

preparing and characterizing a test substrate having test patterns with different structure densities using the process parameters defined;

determining a set of model parameters for simulating the CMP process from results of the characterizing of the test substrate;

determining layout parameters of the substrate to be polished;

defining a profile of demands for a CMP process result for the substrate to be polished; and simulating the CMP process for determining a polishing time required for satisfying the profile of demands;

depositing a layer to be planarized on the substrate; and polishing the substrate for a duration of the polishing time determined from the simulating step.

20. The polishing method according to claim 19, which further comprises:

determining a deposition thickness required to carry out the CMP process during the simulating step; and depositing the layer to be planarized to the deposition thickness required.

21. The simulation method according to claim 19, which further comprises using a semiconductor wafer as the substrate.

* * * * *